US006671381B1

(12) United States Patent
Lux-Wellenhof

(10) Patent No.: US 6,671,381 B1
(45) Date of Patent: Dec. 30, 2003

(54) SLEEVE FOR HEARING AIDS, AND A METHOD AND APPARATUS FOR TESTING HEARING

(76) Inventor: Gabriele Lux-Wellenhof, Feldbergstrasse 33, D-65830 Kriftel (DE)

( * ) Notice: Subject to any disclaimer, the term of this patent is extended or adjusted under 35 U.S.C. 154(b) by 0 days.

(21) Appl. No.: 09/251,378

(22) Filed: Feb. 17, 1999

Related U.S. Application Data

(62) Division of application No. 08/649,582, filed on Sep. 25, 1996, now abandoned.

(30) Foreign Application Priority Data

Nov. 23, 1993 (DE) ..... P 4339898
Nov. 23, 1993 (DE) ..... P 4339899
Mar. 31, 1994 (DE) ..... G 9405529

(51) Int. Cl.[7] ..... H04R 25/00
(52) U.S. Cl. ..... 381/325; 381/328
(58) Field of Search ..... 381/325, 322, 381/328; 181/135

(56) References Cited

U.S. PATENT DOCUMENTS 4,520,236 A 5/1985 Gauthier
4,607,720 A * 8/1986 Hardt ..... 181/135
4,879,750 A * 11/1989 Nassler ..... 381/325
4,987,597 A * 1/1991 Haertl ..... 381/325

FOREIGN PATENT DOCUMENTS

DE 1 616 152 3/1972
EP 0 289 750 11/1988

* cited by examiner

*Primary Examiner*—Forester W. Isen
*Assistant Examiner*—Brian T. Pendleton
(74) *Attorney, Agent, or Firm*—O'Melveny & Myers LLP

(57) ABSTRACT

A sleeve is made available for hearing aids, hearing aids provided therewith, and parts. The sleeve is in the form of a flexible tube or sack and is placed over the hearing aid, (in-the-ear unit) which is inserted in the auditory channel or that part of the hearing aid (behind-the-ear units) which is inserted into the auditory channel. The diameter of the sleeve, which is in the form of a flexible tube, is variable and is thus moulded against the auditory channel wall. The sleeve, which is in the form of a flexible tube, is thus used both for locking the hearing aid in the auditory channel and for protection of the hearing aid against cerumen etc. Furthermore, a hearing test device is made available, using which, in particular, the abovementioned hearing aids can be individually adapted to a wearer. Using the hearing test device, various sounds and sound events can be played back or can be made audible. The test person varies the operating parameters of the respective hearing aid until an optimum sound impression is produced.

7 Claims, 8 Drawing Sheets

SLEEVE FOR HEARING AIDS, AND A METHOD AND APPARATUS FOR TESTING HEARING

This is a divisional of application Ser. No. 08/649,582, filed Sep. 25, 1996 now abandoned.

The invention relates generally to hearing aid technology and, in particular, to a sleeve or protective sleeve for hearing aids or parts of them, to hearing aids or parts of them provided with a sleeve, and to a hearing test device using the abovementioned hearing aids, as well as to a method for operation of this hearing test device.

Hearing aids which are inserted into the auditory channel and are fixed there (concha units, in-the-ear units) and parts of behind-the-ear units which project into the auditory channel are subject to corrosive body fluids and cerumen. This leads in general to hygiene problems and to the risk of inflammation if these parts are not regularly cleaned. In addition, in the case of in-the-ear units, there is a risk of the corrosive body fluids or cleaning fluids making the sensitive electronic and acoustic components unserviceable.

It is known for the end of in-the-ear units which faces the eardrum and the parts of a hearing aid which can be worn in the auditory channel to be provided with a cerumen protective grid. This admittedly prevents the ingress of cerumen, but not the ingress of body fluids.

In the case of hearing aids or hearing boosters for compensation for hearing weaknesses or hearing damage, a distinction is drawn essentially between two types of units, so-called behind-the-ear units and so-called in-the-ear units. The latter are also called auditory channel units or concha hearing aids. In the case of behind-the-ear units, the actual part of the hearing aid, with the electronics, microphone, earphone, battery compartment, control elements etc., is located in a common housing behind the ear and a so-called standard flexible tube or a so-called Libby horn leads from the earphone into the auditory channel. In the case of so-called in-the-ear units, which have been produced in the course of miniaturization of electronic and electromechanical components, the hearing aid is located entirely in the auditory channel or projects out of it into the pavilion of the ear. In-the-ear hearing aids are marketed, for example, by the Siemens Co. under the designation Cosmea Top.

In both types of hearing aid, the part of the hearing aid which is located in the auditory channel or the part of the hearing aid which is located in the pavilion of the ear is surrounded by an otoplasty which is matched to the individual ear shape or auditory channel shape of the wearer and makes it possible for the hearing aid to be seated correctly and to operate correctly (avoidance of feedback etc.). Examples of this are disclosed in DE-OS 39 36 062 and DE Utility Patent 91 15 511.8.

Holes are also introduced into these specially manufactured otoplasties for individual adaptation of the frequency response, for pressure equalization and for voice modulation, and are also used for ventilation of the auditory channel. German Utility Patent G 90 03 269.1 discloses a hearing aid which can be worn in the ear or an otoplasty which has a ventilation channel which can be blocked off to a greater or lesser extent by means of a blocking device, as a result of which the ventilation, the voice modulation etc. can be influenced and can be varied during operation and while being worn.

These otoplasties considerably increase the cost of the hearing aids since they must be individually manufactured. In consequence, the purchasing of a hearing aid also becomes a highly tedious process which leads to hearing aids frequently being bought only when they are absolutely essential, that is to say in the event of a high degree of hearing difficulty. People having minor to medium hearing difficulty frequently avoid buying a hearing aid or an electronic hearing booster for cost, time or else image reasons.

DE Utility Patent 87 12 957.4 discloses an in-the-ear hearing aid which is surrounded by a sleeve in the form of a sack or a double sack. A curable material is inserted into the volume defined by the sleeve and the actual in-the-ear unit or by the interior of the sleeve which is in the form of a double sack, as a result of which an individually adapted otoplasty is produced and the in-the-ear unit is thus fixed in the wearer's ear. It is disadvantageous in the case of this known in-the-ear unit that the earphone and the sound outlet channel from the hearing aid are not exposed until after the curable compound has cured, that is to say after the adaptation of the otoplasty, by cutting off the part which closes the sound outlet channel of the earphone. In consequence, the otoplasty and the hearing aid can not be tested until after the otoplasty has been manufactured. If, for any reason, the hearing aid provided with the individual otoplasty is unsuitable or if the manufactured otoplasty has defects, then a new hearing aid module must be used. This results in the risk of a number of hearing aid modules being "used up" before a suitable hearing aid module has been found. The individual adaptation of this hearing aid according to the prior art is thus in no way cost effective but, on the contrary, is highly cost-intensive.

In order that an optimally adapted hearing aid can be selected and manufactured for a patient suffering from hearing difficulty, the level of his or her hearing difficulty, or his or her hearing ability, must first be determined. Once this has been done, an appropriate hearing aid can then be selected and an otoplasty individually manufactured for it. The conventional known hearing tests are very complex since they can be carried out only by trained specialist personnel. Furthermore, it is disadvantageous that, essentially, unnatural sinusoidal tones are used for testing the hearing ability.

The document FR 2 664 494 A1 discloses a hearing test device by means of which sound events, which are stored on a sound storage device, can be called up via a loudspeaker. The level of recognition of the various sound events (curve b in FIG. 2) is recorded by an investigating person for various hearing aids or for one hearing aid with various settings. In this way, an appropriately individually matched hearing aid is searched for by cooperation between the patient and the investigating person. It is disadvantageous in this case that the investigation can be carried out only with the continuous involvement of an appropriately trained specialist person. The high labour costs thus increase the cost of the investigation method accordingly.

DE-OS 39 00 588 and DE-OS 32 05 685 disclose hearing aids in the case of which specific acoustic operating parameters can be varied.

It is thus an object of the present invention to provide a hearing aid or a part of a hearing aid which can be worn in the ear, which is particularly suitable for forms of slight to medium hearing difficulty and which can be adapted more quickly and cost-effectively to the individual characteristics of a wearer. It is furthermore the object of the invention to specify an improved protective device for hearing aids. In addition, it is an object of the invention, in cases of slight to medium hearing difficulty, to specify a quick and efficient method for individual selection and adaptation of a hearing aid.

It is furthermore an object of the present invention to provide a device for testing the hearing ability of a patient and for selection of an individually adapted hearing aid, which device allows less cost-intensive use. In addition, it is an object of the invention to make available an appropriately matched method for testing the hearing ability of a patient and for selection of an individually adapted or matched hearing aid.

These objects are achieved by the features of claims 1, 9, 10, 32, 35, 38, 48 and 53.

The protective sleeve according to the invention can be pulled, in a simple manner, over the part of a hearing aid—over the otoplasty—which can be inserted into the auditory channel. In consequence, the entire part which is located in the auditory channel is covered by the moisture-proof, thin, elastic sleeve. The acoustically transmissive cap ensures that the acoustic characteristics of the hearing aid are not adversely affected.

The protective sleeve is designed such that, in a slightly expanded state, it reliably adheres to the relevant part of the hearing aid by virtue of the elasticity of the material. It can thus also be removed very easily again; costly cleaning of the hearing aid itself is avoided. The protective sleeve is very highly suitable for use as a disposable article.

The thin, elastic material, preferably a hypoallergenic material such as rubber, feels more pleasant on the skin and warmer than the hard plastic of conventional otoplasties. Since the protective sleeve is supported via the otoplasty and thus rests directly against the skin of the auditory channel, the protective sleeve according to the invention also improves the convenience of wearing hearing aids.

According to an advantageous development of the invention, the protective sleeve is constructed integrally, as a result of which the ingress of liquids at the interface between the cap and the casing is reliably prevented.

According to a further advantageous development of the invention, at least a part of the cap is air-permeable, as a result of which it is possible to carry out the ventilation of the ear and the acoustic adaptation in a normal manner. This is achieved in a simple manner in that the cap is constructed in the form of a grid, in particular in the form of a rubber grid.

An advantageous refinement ensures that the liquid-permeable rubber grid comes to rest, so to speak, in an insulated manner in the auditory channel and does not rest against the skin of the auditory channel. This reduces the risk of ingress of liquid via the grid.

A further advantageous development of the invention reliably prevents corrosive liquids reaching the sensitive parts of the hearing aid in the interior of the protective sleeve.

The advantageous development of the invention according to claim 7 prevents the cap vibrating as a result of soundwaves from the earphone of the hearing aid.

As a result of the fact that the auditory passage unit as such or the part of a behind-the-ear hearing aid which can be worn in the ear—standard flexible tube or Libby horn—is surrounded by a sleeve which is in the form of a flexible tube, whose cross-section is variable, it is possible to adapt standard hearing aids to the individual ear shape of a wearer, in a simple manner. The sleeve, which is in the form of a flexible tube, exposes both the distal end, which faces the eardrum, of a hearing aid and the proximal end, which comes to rest in the pavilion of the ear, of a hearing aid. (the distal end must be at least highly acoustically transmissive). The cross-section of the sleeve, which is in the form of a flexible tube, is variable by mechanical or other means in such a manner that it can be pressed against the auditory channel and can be locked in this position.

According to a preferred embodiment, a sleeve is provided which is in the form of a double flexible tube and defines a cavity which can be filled with a fluid, in particular air, via a closeable opening. The inserted fluid leads to an expansion and thus to an increase in the cross-section of the sleeve, so that said sleeve exactly matches the auditory channel and the concha.

According to a further preferred embodiment of the invention, the sleeve, which is in the form of a flexible tube, is drawn over a standard component, which reflects the shape of the auditory channel only roughly. In the case of in-the-ear units, the standard component may be a conventional hearing aid module which, in the case of conventional hearing aids, is connected to the individually manufactured otoplasty.

In the case of in-the-ear units, and in the case of a preferred embodiment of the invention, a ventilation channel is passed through the interior of the hearing aid, in which the earphone, electronics, microphone etc. are arranged. The risk of operation being adversely affected by the moisture which is present in the ear is low since the individual functional elements can be appropriately sealed or encapsulated.

Using the hearing aids according to the invention or the parts of a hearing aid according to the invention, a hearing aid can be directly matched to the individual ear shape of a wearer and to the level of hearing difficulty on the spot. There is no need to make an impression and to manufacture an otoplasty in an external laboratory. By filling this sleeve, which is in the form of a double flexible tube, on the spot, the individual otoplasty is produced immediately when the suitable hearing aid is selected.

A hearing test device according to the present invention is particularly suitable for the selection of a suitable hearing aid, by means of which hearing test device various sound events can be called up from a sound storage device and can be made audible via a loudspeaker device. A control and operating device allows the acoustic operating parameters of a hearing aid to be varied until a hearing aid is found which is optimally matched to the patient. The patient can freely select the various acoustic parameters, such as the frequency response, gain, output sound pressure level and even the type of amplifier circuit, within certain limits, in order thus to find the most suitable hearing aid for him or her, without any external help.

According to a preferred refinement of the invention, the associated meaning is called up at the same time as a specific sound event, either in the form of an announcement text or in the form of a visual display from the sound storage device, and is displayed in a display device. In this way, the patient can always immediately assess whether a specific sound event, for example the rustling of leaves in the wind, does or does not sound natural with the currently set hearing aid parameters.

If the sound event is a spoken text, this spoken text is displayed on the display device. According to preferred embodiments of the invention, the sound event itself and the associated meaning are stored in the form of a text, a visual representation etc., jointly, in the sound storage device. In consequence, any desired sound effects can be selected, and the patient or a carer does not need to worry about the association between the acoustically occurring sound event and the display of the associated meaning. The sound events can be repeated as often as desired.

According to further advantageous refinements, the standard shell of the hearing aid has an elastic sleeve, which is replaceable for reasons of hygiene. In this way, the same standard shells can be used for different people. According to a particularly preferred embodiment, this sleeve is a sleeve which is in the form of a flexible tube or a double flexible tube, which can be filled with a fluid, in particular air, so that the hearing aid can then be optimally matched to the auditory channel of the respective patient. The sleeves and hearing aids described above, with a sleeve, are particularly suitable for this purpose.

Any desired hearing aids or hearing amplifiers can be used as the hearing aid. In order to simplify interchangeability, the hearing aid is preferably fitted on a supporting device, for example a stetho clip. The hearing aid can be controlled and operated via a cable, which connects the hearing aid and the control and operating device, or else by means of infrared beams or the like.

According to a preferred embodiment, various noises, such as the rustling of a newspaper or alarm clock bells, can also be produced in a natural manner, that is to say, these sound events are not called up from the sound storage device but are produced directly by the patient himself or herself.

In order to avoid injuries to the patient, critical parameters, such as the gain and the output sound pressure level of the hearing aid for example, can be freely selected only in ranges below the hearing damage limit. Should values beyond these limits be necessary, these can, of course, be set by an appropriate specialist.

The further subclaims relate to further advantageous refinements of the invention.

Further details, features and advantages of the invention result from the following description of preferred embodiments, with reference to the drawing, in which.

Figure 6A:
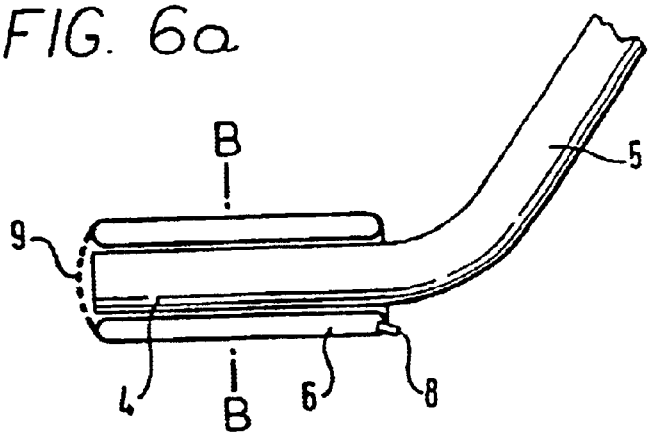
Figure 6B:
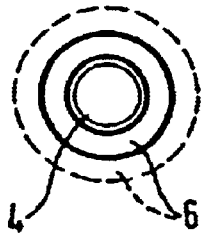

FIG. 6*a* shows a sectional illustration of a first embodiment of the invention for a part of a behind-the-ear hearing aid which can be worn in the ear;

FIG. 6*b* shows a section along the line B—B in an exemplary embodiment according to FIG. 6*a;*

Figure 6C:
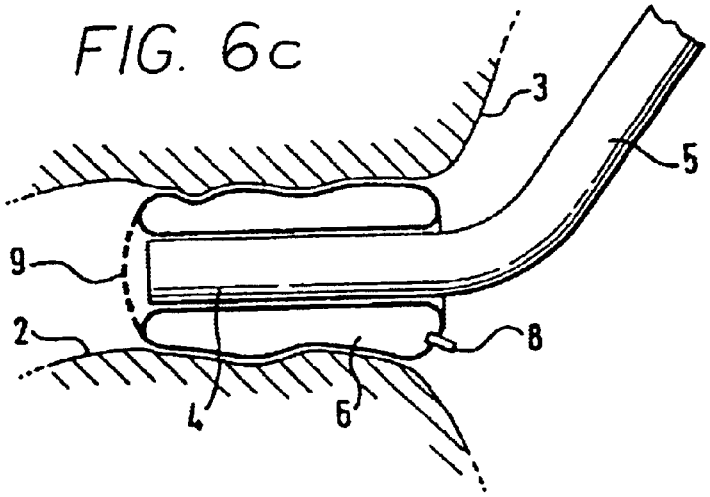
Figure 7:
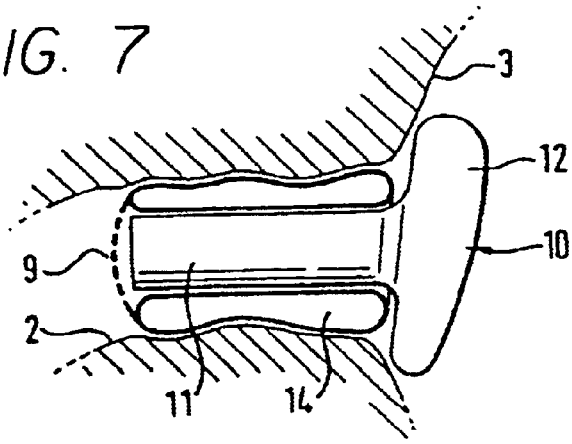
Figure 8:
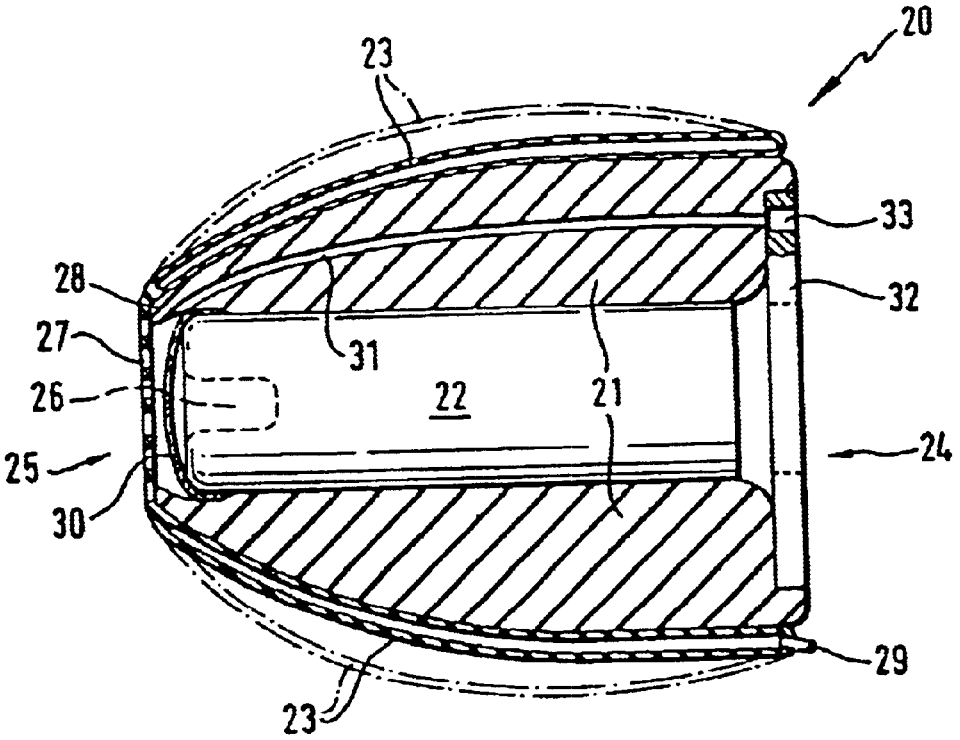
Figure 9:
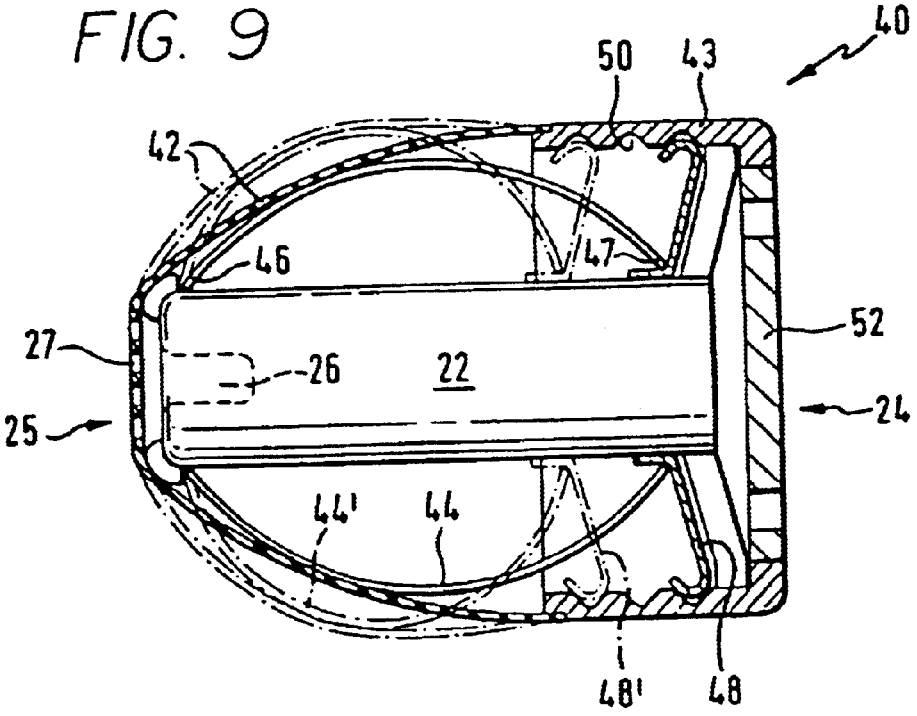
Figure 10A:
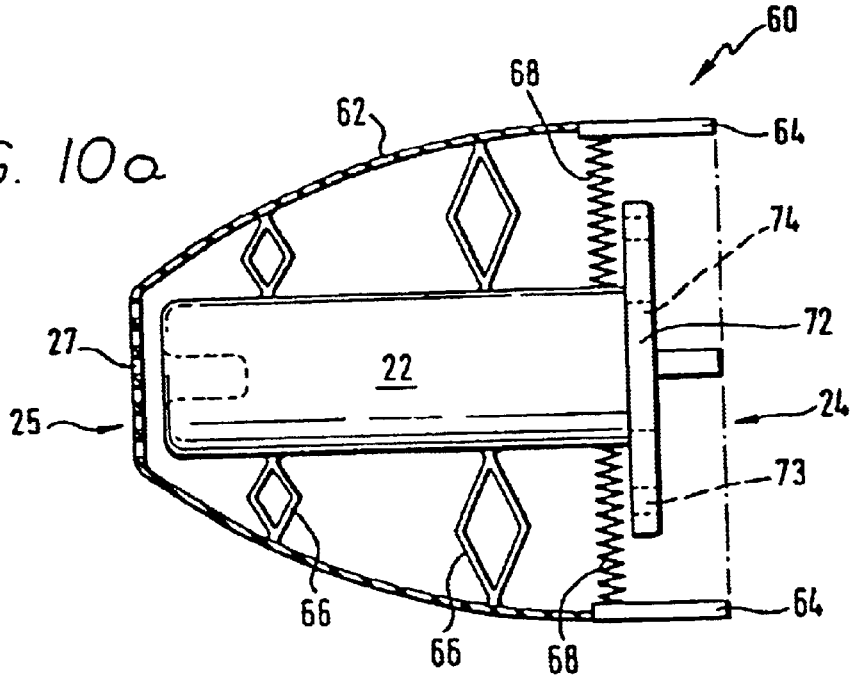
Figure 11:
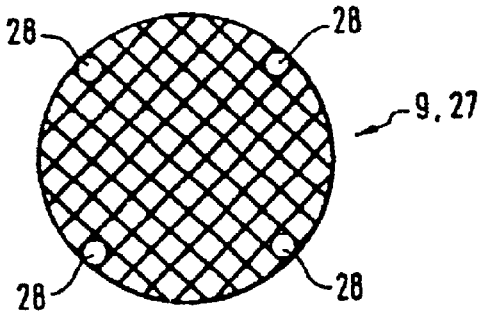
Figure 12B:
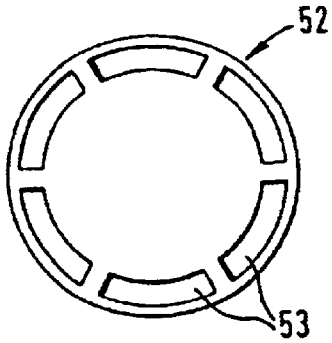
Figure 12C:
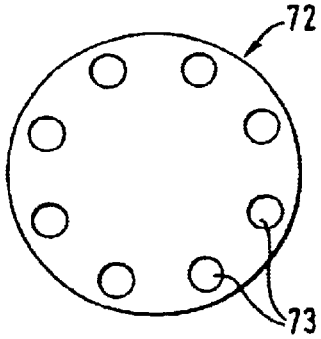
Figure 12A:
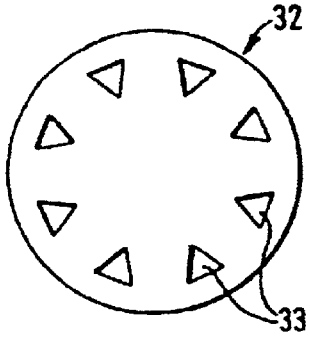
Figure 13A:
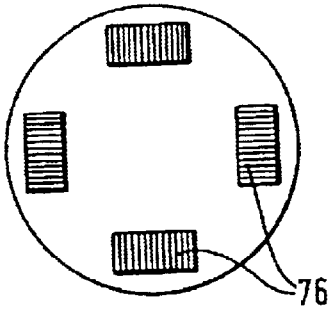
Figure 14A:
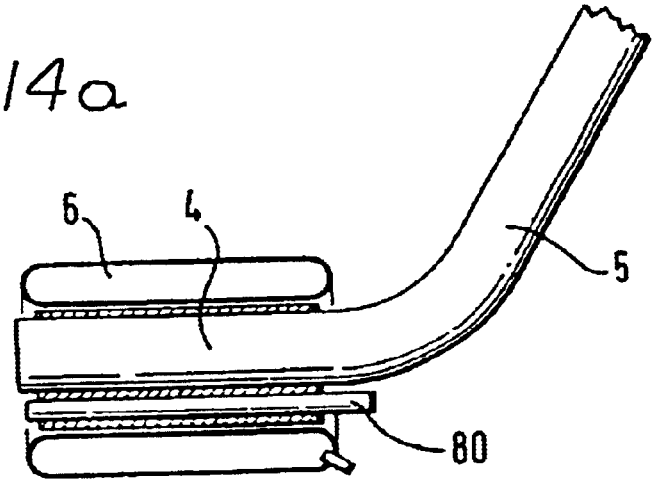

FIG. 6*c* shows an illustration, corresponding to FIG. 6*a*, in which the sleeve is pressed against the auditory channel;

FIG. 7 shows a further embodiment of the invention in the form of a concha unit;

FIG. 8 shows a further embodiment of the invention in the form of an auditory channel unit, FIG. 9 shows a second embodiment of an auditory channel unit, FIGS. 10*a,b,c* show a third embodiment of an auditory channel unit, FIG. 11 shows an exemplary embodiment of a protective cover for the part of a hearing aid which faces the eardrum;

FIGS. 12*a,b,c* show various examples of front plates by means of which the proximal end of an in-the-ear unit can be closed off;

FIGS. 13*a,b* show two options for mounting these front plates on the proximal end of the in-the-ear unit; and FIGS. 14*a,b,c* show a sectional illustration of a second embodiment of the invention for a part of a behind-the-ear hearing aid which can be worn in the ear.

Figure 15:
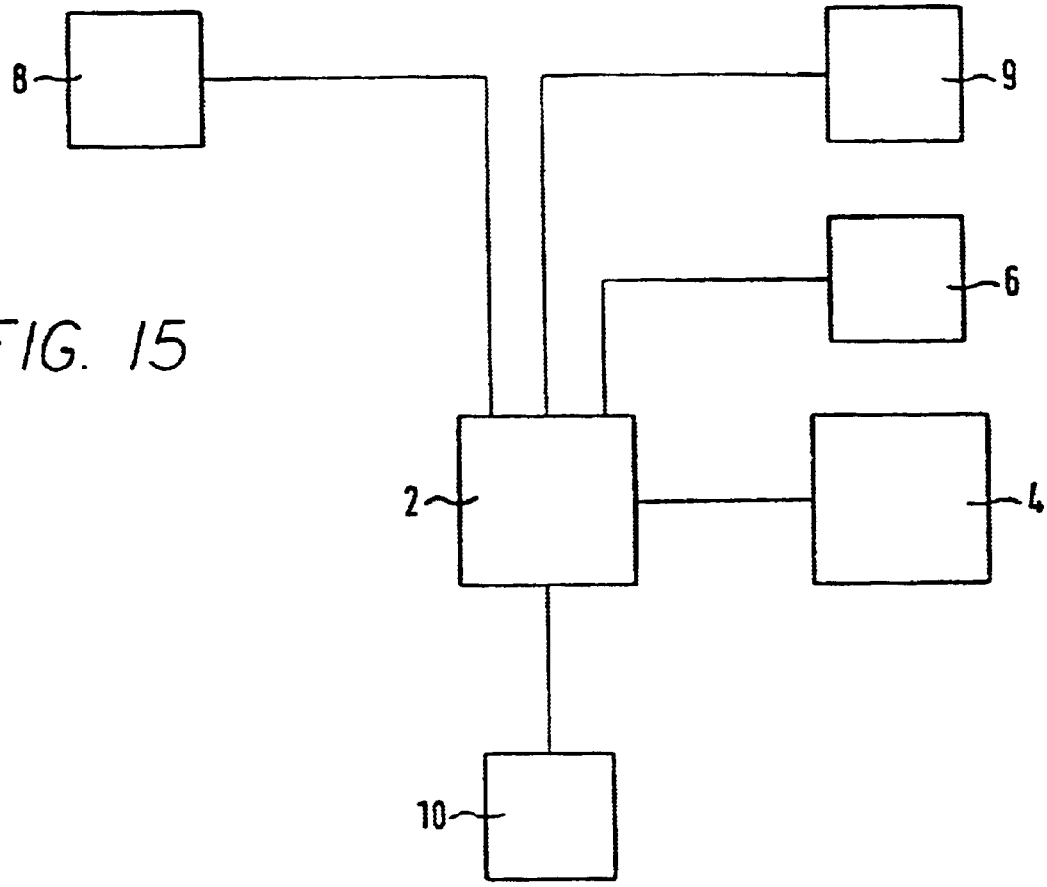
Figure 16:
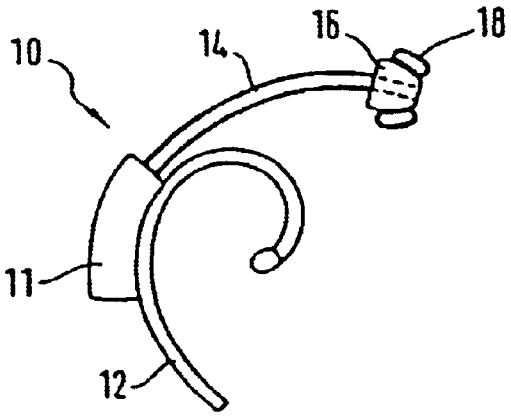

FIG. 15 shows a block diagram with the schematic construction of the hearing test device according to the invention; and FIG. 16 shows a schematic illustration of the test hearing aid.

Figure 1:
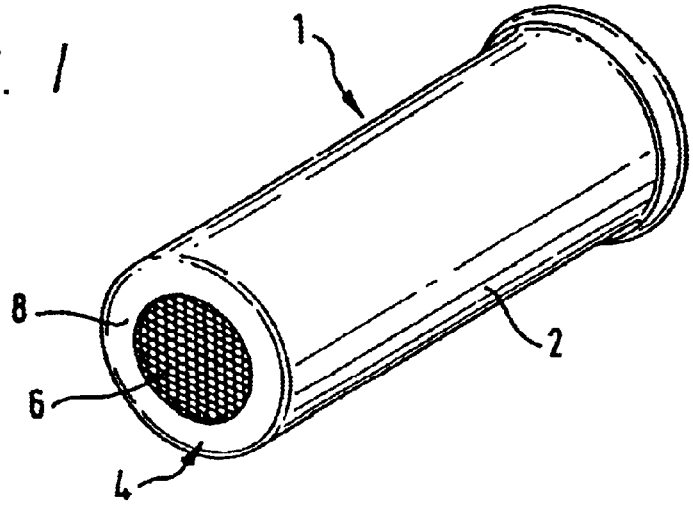
FIG. 1 shows a perspective illustration of an exemplary embodiment of the protective sleeve, viewed from the cap.
Figure 2:
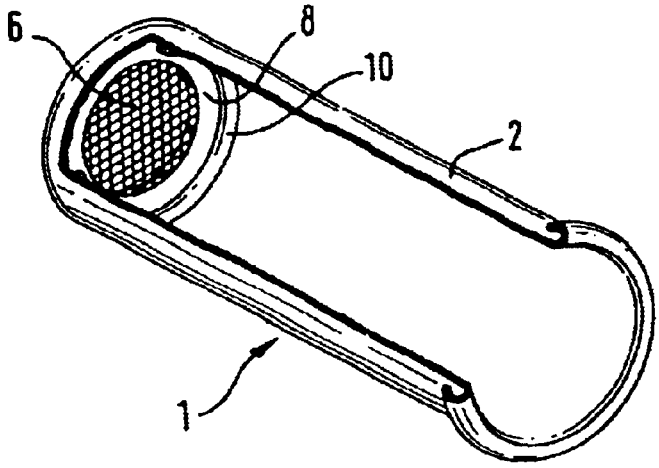
FIG. 2 shows a perspective illustration—partially cut away—of the embodiment according to FIG. 1, viewed from the open end.
Figure 3:
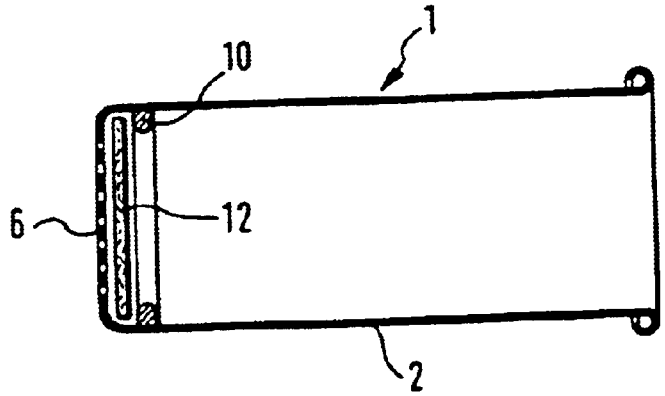
FIG. 3 shows a longitudinal section through the embodiment according to FIGS. 1 and 2.

FIGS. 1 to 3 show a first embodiment of a protective sleeve 1 according to the invention. The protective sleeve 1 comprises a casing 2, which is in the form of a flexible tube and has two open ends, one of the open ends being closed off by an acoustically transmissive cap 4. The cap 4 and the casing 2 are composed of a hypoallergenic, elastic material, for example rubber, and merge into one another, that is to say that the protective sleeve 1 is constructed integrally. The cap 4, which closes off one of the ends of the casing 2 in the form of a dome, has a rubber grid 6 which is acoustically highly transmissive and is air-permeable. The rubber grid 6 is bounded by a liquid-proof cap edge 8, which merges into the casing 2.

Arranged behind the cap 4 in the interior of the protective sleeve 1 is a bead 10 which is circumferential in the form of a ring and is mounted on the inside of the casing 2 at a distance from the rubber grid 6 and the cap edge 8. The bead 10 is preferably composed of the same material as the rest of the protective sleeve 1.

A means which absorbs moisture, for example a gauze strip 12, is arranged between the rubber grid 6 and the bead 10. The gauze strip 12 absorbs any moisture which may penetrate via the rubber grid 6 in the interior of the protective sleeve 1.

Figure 4:
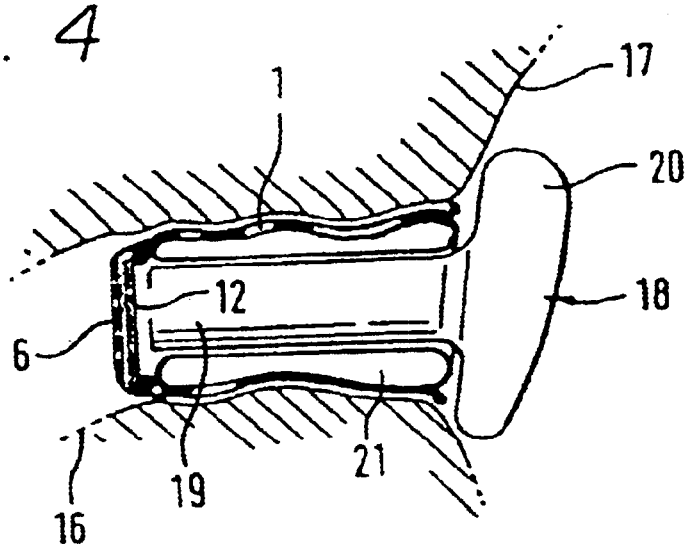
FIG. 4 shows a sectional illustration of a concha unit with the protective sleeve according to FIGS. 1 to 3.

FIG. 4 shows a longitudinal section through a hearing aid 18 which is inserted into an auditory channel 16 or into the pavilion of the ear 17, has a part 19 which projects into the auditory channel 16 and has a part 20 which is seated in the pavilion of the ear 17. The part 19 is surrounded by an otoplasty 21. The part 19 or the otoplasty 21 has the protective sleeve 1 drawn over it.

Figure 5:
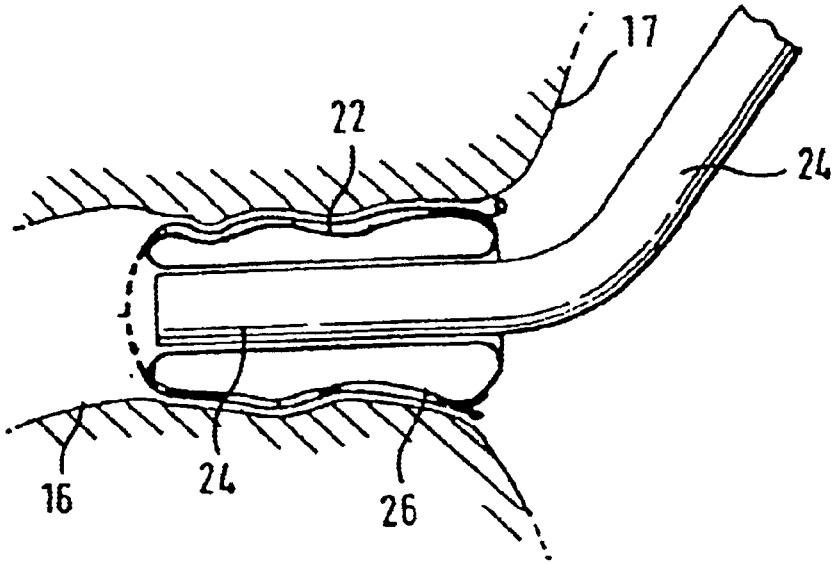
FIG. 5 shows a sectional illustration of a part of a hearing aid which can be worn in the ear or in the auditory channel, with a further embodiment of the protective sleeve.

FIG. 5 shows a further embodiment of a protective sleeve 22 in an illustration corresponding to FIG. 4, which protective sleeve 22 is placed over a part 24 which projects into the auditory channel 16. The part 24 is used as a sound conductor and is likewise fixed in the ear or in the auditory channel 16, using an otoplasty 26, in a known manner. The protective sleeve 22 is placed over the part 24 or the otoplasty.

The protective sleeves can be rolled up like a condom before use and can thus be pulled onto the appropriate part of the hearing aid, and can be removed again, in a simple manner.

FIGS. 6*a*, 6*b* and 6*c* show an exemplary embodiment of the invention for behind-the-ear units. The part 4 of a standard flexible tube 5 which can be inserted into an auditory channel 2 and projects into the pavilion of the ear or the concha 3 is surrounded by an elastic sleeve 6, which is in the form of a double flexible tube. The sleeve 6, which is in the form of a double flexible tube, has a closeable opening 8 which is accessible from the pavilion of the ear 3. The end of the standard flexible tube 5 or of the sleeve 6 which faces the eardrum is provided with a protective cover 9, which protective covers 9 prevent the ingress of cerumen into the standard flexible tube 5. FIG. 6*b* illustrates a section along the line B—B in FIG. 6*a*.

The standard flexible tube 5 is inserted, with the sleeve 6 which is in the form of a double flexible tube, in the normal manner in the auditory channel 2. Subsequently, the sleeve 6, which is in the form of a double flexible tube, is filled via the closeable opening 8 with a fluid, in particular air, so that the elastic sleeve 6 expands and moulds itself to the individual shape of the auditory channel 2 and of a part of the pavilion of the ear 3. The inflated state of the sleeve 6 is illustrated by dashed lines in FIG. 6*b*.

FIG. 7 shows a sectional illustration, corresponding to FIG. 6*c*, through a concha unit 10 having a part 11 which projects into the auditory channel 2, and having a part 12 which covers a part of the pavilion of the ear 3 (also called concha). The part 11 which projects into the auditory channel 2 is provided with a sleeve 14, which is in the form of a double flexible tube. Once again, in the inserted state, a fluid can be introduced via a closeable opening, which is not illustrated, into the sleeve 14 which is in the form of a double flexible tube, so that the sleeve 14 matches itself to the respective shape of the auditory channel 2 and the pavilion of the ear 3 of the wearer.

FIG. 8 shows an exemplary embodiment of the invention in the form of an auditory channel unit 20. The auditory channel unit 20 comprises a hearing aid module 22, which is surrounded by a slightly conical rubber plug 21 which is matched to the rough shape of an auditory channel 2 and is in turn surrounded by a sleeve 23 which is in the form of a double flexible tube and is composed of an elastic, hypoallergenic material. The hearing aid 20 thus tapers from a broad proximal end 24 to a distal end 25 which faces the eardrum and has a smaller cross-section. The hearing aid module 22 has an earphone output 26 which faces the distal end 25 of the hearing aid. An acoustically transmissive and air-permeable protective cover is provided at the distal end 25 of the hearing aid 20, which protective cover is in the form of a rubber grid 27 and is constructed integrally with the sleeve 23. In order to improve the acoustic characteristics, spacer elements 28 are provided between the rubber grid 27 and the earphone output 26. A moisture-absorbent strip 30, for example in the form of a gauze strip, is arranged between the rubber grid 27 and the earphone output 26 in order that the moisture which is present in the ear can not penetrate into the actual hearing aid module 22. The sleeve 23, which is in the form of a double flexible tube, has a closeable opening or a valve 29, using which the sleeve 23 can be filled—as in the case of the embodiment according to FIGS. 6 and 7—with a fluid, so that said sleeve 23 is moulded against the auditory channel 2.

The rubber plug 21 has one or more holes 31 which extend from the distal end 25 to the proximal end 24 and are used as a ventilation channel and for influencing and improving the voice modulation. The distal end 24 of the hearing aid 20 is closed off by a detachable front plate 32, which may have differently shaped openings 33, as is illustrated in FIGS. 11*a*, 11*b* and 11*c*. By appropriate selection of the shape, size and number of the openings 33 in the front plate 32—see FIG. 12*a*—voice modulation, feedback effects, etc. can be modified, together with the holes in the rubber plugs 21, in a similar manner to that which is disclosed in DE Utility Patent 90 03 269.1. In addition, the holes in the rubber plug 21 can also be closed variably to a greater or lesser extent, as is disclosed in DE Utility Patent 90 03 269.1.

The earphone, electronics, microphone, battery etc. are accommodated in the hearing aid module 22, in a manner which is not illustrated in more detail. The battery chamber is accessible from the proximal end 24. The ventilation of the auditory channel and the influencing of modulation, feedback etc. can also be carried out via one or more channels which are passed through the interior of the hearing aid module.

The embodiment of the invention according to FIG. 9 likewise shows an auditory channel unit 40 corresponding to the embodiment as shown in FIG. 8, and differs from the latter by the structural design of the mounting in the auditory channel by means of a sleeve which has a variable cross-section and is in the form of a flexible tube. Components which correspond to the embodiment according to FIG. 8 are provided with the same reference symbols.

The hearing aid module 22 is surrounded by a sleeve 42 which is in the form of a flexible tube, is connected at the distal end 25 to the protective cover 27 and is mounted at the proximal end 24 on a dimensionally stable ring 43, which is firmly connected to the hearing aid module 22. Arranged between the sleeve 42, which is in the form of a flexible tube, and the surface of the hearing aid module 22 are one or more elastically flexible elements 44, which are mounted at one end 46 on the distal end 25 of the hearing aid module 22. A rigid or dimensionally stable part 48 is provided at the other end 47 of the elements 44 and engages in a groove system 50 which is provided on the ring 44. By pressing the element 48 in the direction of the eardrum or in the direction of the distal end 25, the element 44 is bent and presses the sleeve 42, which is in the form of a flexible tube, against the auditory channel. The rigid element 48 latches in a position more in the direction of the distal end 25 in the groove system 50, and the auditory channel unit 40 is mounted in the ear. This position is illustrated by dashed lines in FIG. 9 and by the reference symbols 44' and 48'. In order to remove the auditory channel unit 40, the rigid part 48' is just pressed out of the groove system 50, so that the element 44 becomes essentially straight again and the sleeve 42, which is in the form of a flexible tube, is no longer pressed against the auditory channel. The proximal end 24 of the auditory channel unit 40 can be closed, as in the case of the embodiment according to FIG. 8, by a front plate 52—FIG. 12*b*—with individually matched openings 53.

Figure 10B:
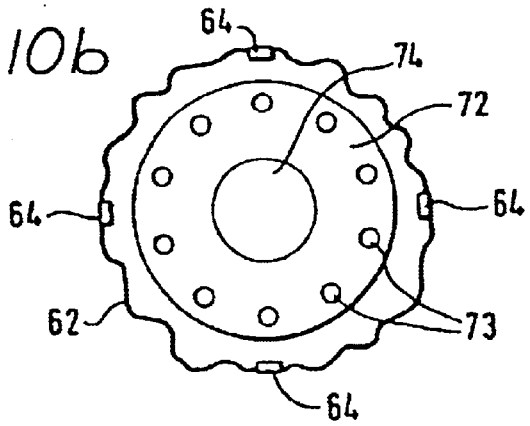

The embodiment of the invention according to FIG. 10 likewise shows an auditory channel unit 60 corresponding to the embodiments as shown in FIGS. 8 and 9 and differs from them by the structural design of the mounting in the auditory channel by means of a sleeve which has a variable cross-section and is in the form of a flexible tube. Components corresponding to the embodiments as shown in FIGS. 8 and 9 are provided with the same reference symbols.

Figure 10C:
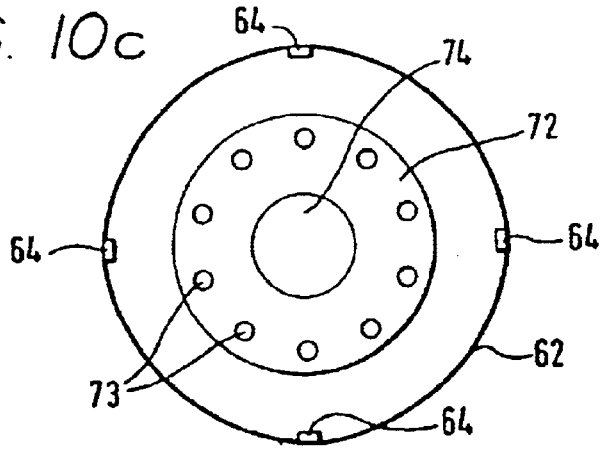

The hearing aid module 22 of the auditory channel unit 60 is surrounded by a sleeve 62 which is in the form of a flexible tube. A plurality of reinforcing elements 64—four in FIG. 10—which are mounted on the hearing aid module 22 by means of attachments 66 are provided, distributed over the circumference, under the sleeve 62. The reinforcing elements 64 project beyond the end of the hearing aid module 22 at the proximal end 24. The sleeve 62, which is in the form of a flexible tube, is connected to the protective cover 27 at the distal end 25. Spring elements 68 are provided at the proximal end 24 and are mounted on the one hand on the hearing aid module 22 and on the other hand on the reinforcing elements 64. The spring elements 68 hold the sleeve 62 at a distance from the hearing aid module 22 and press the sleeve 62 against the auditory channel. In consequence, the sleeve 62 is pressed against the auditory channel, in the manner of an umbrella mechanism. Before insertion of the auditory channel unit 60 in the auditory channel, the spring elements 68 are compressed via the reinforcing elements 64 so that the sleeve 62 relaxes (see FIG. 10*b*) and has a reduced diameter and cross-section. When the auditory channel unit 60 is inserted into the auditory channel, the reinforcing elements 64 are released and the spring elements 68 press the sleeve 62 against the wall of the auditory channel (FIG. 10*c*).

A front plate 72—see FIG. 12*c*—which has a plurality of openings 73 is arranged at the proximal end 24. The function of the front plate 72 is identical to the function of the front plate 32 or 52. A battery chamber cover 74 is introduced into the front plate 72.

FIG. 11 shows a detailed illustration of the protective cover 9 or 27 in the form of a rubber grid, as can be used for the various embodiments of the invention. A rubber grid as the protective cover is advantageous since this is both acoustically transmissive and air-permeable and nevertheless reliably keeps cerumen away. The protective cover 9 or 27 can preferably be constructed integrally with the respective sleeve 6, 23 or 42, which is in the form of a flexible tube or a double flexible tube, and may be composed of the same hypoallergenic material. An acoustically transmissive and air-permeable membrane can also be used instead of a grid.

FIGS. 12*a, b* and *c* show various variants of the front plate 32, 52 or 72, as can be used in the embodiments according to FIGS. 3, 4 and 5. The shape, size and number of the openings 33, 53 and 73 in the front plate 32, 52 or 72 respectively on the one hand allow the hearing aid acoustic parameters, such as voice modulation, feedback etc., to be influenced, and, furthermore, the aesthetics and the appearance of the hearing aid as well. This may be important, particularly in the case of young wearers.

Figure 13B:
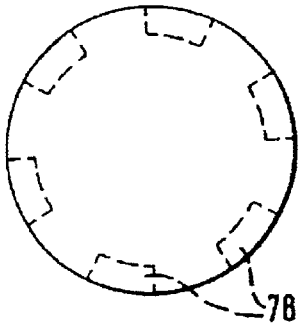

Finally, FIGS. 13*a* and 13*b* show two different options for mounting the front plate 32, 52, 72 at the proximal end of the hearing aid. FIG. 13*a* shows an embodiment with displaceable closure elements 76, and FIG. 13*b* shows an embodiment of the front plate 32, 52, 72 with a rotary closure mechanism 78.

Figure 14B:
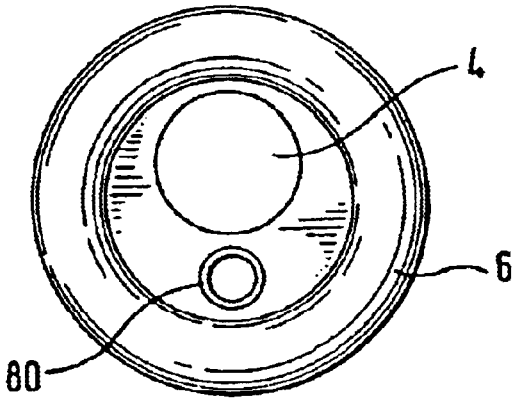
Figure 14C:
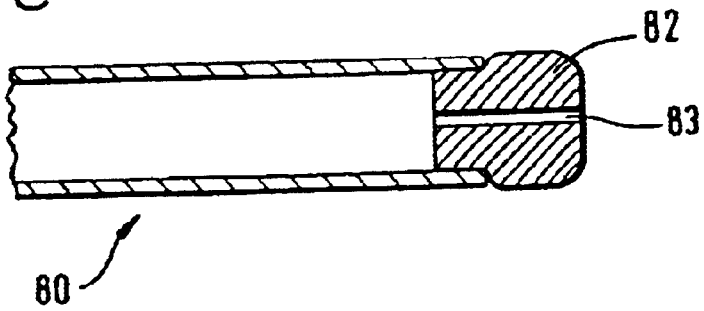

FIG. 14 shows an embodiment of the invention for a behind-the-ear unit, by means of which voice modulation, feedback, ventilation of the auditory channel etc. can be influenced and individually adapted. Components which correspond to the embodiment according to FIG. 6 are provided with the same reference symbols. Arranged underneath the sleeve 6 and parallel to the part 4 of the standard flexible tube 5 is a flexible ventilation tube 80 which allows air to be exchanged between the outside world and the region of the auditory channel between the eardrum and part 4 of the standard flexible tube 5.

This flexible ventilation tube 80 has a defined internal diameter, in order to influence voice modulation, feedback effects, ventilation, etc. Alternatively, the flexible ventilation tube 80 can be provided at the proximal end, that is to say at the end which is accessible from the pavilion of the ear, with a plug 82 which has a hole 83 with a defined diameter, as can be seen from FIG. 14*c*. Since the plug 82 is accessible from the outside, a plug 82 with a suitable hole 83 can be selected on the spot. Furthermore, blocking means can be provided in the flexible ventilation tube 80, which are not illustrated in more detail and by means of which the flexible ventilation tube 80 can be blocked off to a greater or lesser extent. Reference should be made to the entire contents of Utility Model 90 03 269.1, for this option.

The battery chamber of a hearing aid can also be covered by the front plate. The cover of the battery chamber can also be introduced into the front plate, as can be seen from FIGS. 10*b* and 10*c*. The microphone opening can be arranged both under and on the front plate. A solar cell for supplying power for the hearing aid can also be arranged on the front plate.

The elastic sleeve 6, 23, 42 or 62, which is in the form of a flexible tube or double flexible tube, is manufactured in various sizes and strengths so that rough matching to the respective dimensions of the auditory channel can be carried out even in the unexpanded state.

Using the hearing aids according to the invention, it is also possible to select, on the spot, a hearing aid which is matched to the respective characteristics of the wearer. To do this, a hearing aid having a sleeve which is in the form of a double flexible tube is inserted initially and air is blown into the sleeve so that the sleeve is moulded tightly against the auditory channel and the concha. The acoustic characteristic data are then determined and a hearing aid is selected which is optimally matched to the respective hearing ability. In the case of in-the-ear units, the front plate is also individually matched at the same time. Finally, the air is drawn out of the sleeve which is in the form of a double flexible tube, and said sleeve is filled with a quick-curing plastic compound instead. The seating and matching shape of the otoplasty, which is produced on the spot, can be optimized by the wearer making chewing movements.

FIG. 15 shows schematically a refinement, by way of example, of the hearing test device according to the present invention.

The hearing test device which is illustrated in FIG. 15 comprises a central operating and control device 2, which is connected to a sound storage device 4, to a display device 6, to a loudspeaker device comprising two loudspeaker boxes 8 and 9, and to a test hearing aid 10.

As can be seen from FIG. 16, the test hearing aid 10 comprises a stetho clip 12, on which a hearing aid module 11 is mounted. The hearing aid module 11 is connected via a standard flexible tube 14 to a standard shell 16 which is inserted into the auditory channel of the patient. The standard shell 16 is surrounded by an elastic sleeve 18, which is in the form of a double flexible tube and is composed of hypoallergenic material. Frequency problems and problems with the voice pattern of the user can be overcome, by suitably trained specialist personnel, by using different standard flexible tubes and by the insertion of flexible sound tubes of defined diameter between the standard shell 14 and the hearing aid module 11. These flexible sound tubes are at the same time used for ventilation of the auditory channel. Reference is also made to the above statements with respect to the function and construction of these flexible sound and ventilation tubes.

Various amplifier circuits such as AGCi, AGCo, PC, and kAMP circuits etc. can be represented and implemented using the hearing aid module 11. The electronics which implement these various amplifier types can be accommodated either in the hearing aid module 11 itself or externally, for example in the control and operating device.

The patient or user of the hearing test device according to the invention is given the stetho clip with the hearing aid module 11. The standard shell 14 of the hearing aid 10 is inserted, with the sleeve 16, into the auditory channel and air is blown into the sleeve 18 via a valve (not illustrated) in the sleeve 18, so that the sleeve 18 is moulded tightly against the auditory channel of the patient. In this way, the auditory channel is sealed and feedback is prevented.

Subsequently, the user can himself or herself set different operating parameters on the test hearing aids using the operating and control device 2, that is to say he or she can, for example, vary the gain in 5 to 10 dB steps in a range from 15 to 60 dB, and he or she can vary the frequency response in a range from 100 to 6000 Hz (in the range between 20 and 20000 Hz) for earphones with a more broadband response), both broadband transmission and selective transmission of various relatively narrow frequency ranges being possible in this case.

For the actual test of the hearing aid, the patient can call up from the sound storage device 4 various noises or sound events known to him or her whose significance for visual display is displayed on display device 6 and is at the same time emitted acoustically by the loudspeakers 8 and 9. As a result of the fact that the sound event currently being produced is indicated or displayed visually on the display device 6, the patient knows precisely which sound event has just rung or been produced and he or she thus also knows how such a sound event, such as the noise from leaves in the wind for example, should sound. He or she can thus vary the various operating parameters of the test hearing aid until he or she finds a sound impression which is optimum and natural on the basis of his or her own subjective impression.

The testing of speech understanding is carried out by calling up a sound event which represents spoken text. In this case, it may be worthwhile not displaying the meaning of the text visually since understanding of speech has less to do with the natural nature of the sound than with the understanding of it.

During this self test by the patient, it is naturally advantageous if the patient does not have complete freedom in the selection of the various parameters. Instead of this, it is also possible using the hearing test device according to the invention to carry out and run through specific preselected test patterns. That is to say there is a "dialogue" between the hearing test device and the patient, in the course of which the patient can select various alternatives. Using the respectively selected alternative, the test program will then decide how the test program will be continued and which amplifier circuits and hearing aid types should be tested further. During such a program-controlled self-test, the patient will primarily select the level of gain, that is to say will be able to determine the volume freely, while the other operating parameters of the hearing aid are selected under program control. It is, of course, also sensible for trained specialist personnel to be available at all times for patients' questions.

When the patient has finally found a hearing aid which is optimum for his or her requirements, this can be matched to the individual auditory channel of the patient immediately, on the spot, by letting the air escape from the sleeve 18, which is in the form of a double flexible tube, and filling it with a fast-curing plastic compound, instead. The seating of the hearing aid and of the standard shell in the auditory channel is optimized by the patient making chewing movements. Subsequently, the patient's individually matched hearing aid, that is to say, a hearing aid which is not linked to the actual hearing test device, can be tested once again by calling up various sound events.

Two or more loudspeakers, arranged separated in three dimensions are preferably used for the loudspeaker devices in order also to test the hearing directionality of the patient and to allow an optimum hearing aid to be selected for this purpose. It is, of course, also possible for various sound events to be produced by means of a headset.

Both analogue sound stores, such as audio tape etc., and digital stores, such as CD or, for example, PC and CIA memory cards, can be used for the sound storage devices. The control and operating device may be, in particular, a standard PC with appropriately set up peripherals. The peripherals would in this case comprise, in particular, a so-called sound card by means of which digitally stored sound events can be converted into corresponding analogue electrical signals which are then produced as sound in the loudspeaker device. The use of a PC as the control and operating device also has the advantage that it is possible to move to different test programs in a simple manner, namely by software. For such test programs, it is also possible to use neural networks, which are capable of learning and automatically match themselves to the respective patient.

What is claimed is:

1. A protective sleeve for a hearing aid, the hearing aid being wearable in an auditory channel of an ear, the sleeve comprising:

a casing in the form of a flexible tube composed of a moisture-proof, elastic material;

an acoustically highly transmissive cap covering an end of the casing and firmly connected to the casing; and means for absorbing moisture disposed in an interior of the protective sleeve and behind the cap;

wherein the protective sleeve is drawn over a portion of the hearing aid; and wherein a portion of the cap is air-permeable.

2. The protective sleeve according to claim 1, wherein the means for absorbing moisture further comprises a gauze strip.

3. The protective sleeve according to claim 1, wherein the casing and the acoustically transmissive cap are integrally constructed.

4. The protective sleeve according to claim 1, wherein the air-permeable portion of the cap is constructed in the form of a rubber grid.

5. The protective sleeve according to claim 4, wherein the gridded portion of the cap is surrounded by an annular boundary which forms an edge of the cap.

6. The protective sleeve according to claim 1, further comprising:

a bead disposed in the interior of the protective sleeve and behind the cap;

wherein the bead is circumferential and in the form of a ring.

7. The protective sleeve according to claim 1, wherein the cap are composed of a hypoallergenic material.

* * * * *